US008127963B2

(12) United States Patent
Gerson et al.

(10) Patent No.: US 8,127,963 B2
(45) Date of Patent: Mar. 6, 2012

(54) LIQUID CONTAINER SYSTEM FOR A SPRAY GUN

(75) Inventors: Ronald L. Gerson, Carlisle, MA (US); Robert A. Brunell, Forestdale, MA (US); David Anteski, Easton, MA (US)

(73) Assignees: Saint-Gobain Abrasives, Inc., Worcester, MA (US); Saint-Gobain Abrasifs, Confians-Sainte-Honorine ( * ) Notice: Subject to any disclaimer, the term of this patent is extended or adjusted under 35 U.S.C. 154(b) by 1407 days.

(21) Appl. No.: 11/302,970

(22) Filed: Dec. 14, 2005

(65) Prior Publication Data

US 2006/0196891 A1 Sep. 7, 2006

Related U.S. Application Data

(60) Provisional application No. 60/668,695, filed on Apr. 6, 2005, provisional application No. 60/638,949, filed on Dec. 23, 2004, provisional application No. 60/636,675, filed on Dec. 16, 2004.

(51) Int. Cl.
*B65D 35/14* (2006.01)

(52) U.S. Cl. ..... 220/495.02; 220/495.08; 220/495.11; 222/386.5; 222/105

(58) Field of Classification Search ..... 239/345, 239/376, 377; 220/784, 495.08, 495.02, 220/495.11; 222/386.5, 92, 105
See application file for complete search history.

(56) References Cited

U.S. PATENT DOCUMENTS

| | | | | |
|---|---|---|---|---|
| 1,703,384 | A | | 10/1924 | Birkenmaier. |
| 2,612,404 | A | | 9/1952 | Andersson |
| 2,770,706 | A | | 11/1956 | Vogtle et al. |
| 3,255,972 | A | | 3/1964 | Hultgren et al. |
| 3,136,486 | A | * | 6/1964 | Docken ..... 239/346 |
| 3,167,210 | A | * | 1/1965 | Carney, Jr ..... 220/495.05 |
| 3,236,459 | A | | 2/1966 | McRitchie |
| 3,381,845 | A | * | 5/1968 | Macdonald ..... 220/301 |
| 3,401,842 | A | * | 9/1968 | Morrison ..... 222/183 |
| 3,432,104 | A | | 3/1969 | Kaltenbach |
| 3,776,408 | A | | 12/1973 | Wald |
| 3,779,419 | A | * | 12/1973 | Heitz ..... 220/495.11 |
| 3,858,810 | A | * | 1/1975 | Seeley et al. ..... 239/121 |
| 3,892,360 | A | | 7/1975 | Schlottmann et al. |
| 4,043,510 | A | * | 8/1977 | Morris ..... 239/323 |

(Continued)

FOREIGN PATENT DOCUMENTS

DE 298 25 015 U1 4/2004

(Continued)

*Primary Examiner* — Anthony Stashick
*Assistant Examiner* — Christopher McKinley
(74) *Attorney, Agent, or Firm* — Abel Law Group, LLP; Joseph P. Sullivan

(57) ABSTRACT

A liquid container system for a spray gun. The container system includes an outer cup, a collapsible liner for holding a liquid to be sprayed, and a lid for closing the liner. A mounting ring may be used in the cup to make locking engagement with the lid. A lip at the open end of the liner is supported by the mounting ring. A removable lid with a liquid outlet is inserted into the mounting ring, clamping the liner lip to the mounting ring and providing for leak-free operation of the system. Alternatively, the lid may include a cylindrical portion for making sealing engagement with the open end of the liner and projection threads for locking the cup. An adapter connects the liquid outlet of the lid to the spray gun. A collar may facilitate locking engagement of the adapter with the lid.

26 Claims, 20 Drawing Sheets

U.S. PATENT DOCUMENTS

| | | | | | |
|---|---|---|---|---|---|
| 4,151,929 | A | | 5/1979 | Sapien | |
| 4,307,820 | A | * | 12/1981 | Binoche | 220/374 |
| 4,430,084 | A | * | 2/1984 | Deaton | 604/317 |
| 4,625,890 | A | * | 12/1986 | Galer | 220/319 |
| 4,925,055 | A | * | 5/1990 | Robbins et al. | 220/495.06 |
| 4,930,644 | A | | 6/1990 | Robbins | |
| 4,936,511 | A | | 6/1990 | Johnson | |
| 4,971,251 | A | | 11/1990 | Dobrick et al. | |
| 5,094,543 | A | * | 3/1992 | Mursa | 366/247 |
| 5,118,003 | A | * | 6/1992 | Pepper et al. | 220/495.08 |
| 5,248,089 | A | * | 9/1993 | Bekius | 239/154 |
| 5,381,918 | A | * | 1/1995 | Dahl | 220/784 |
| 5,468,383 | A | | 11/1995 | McKenzie | |
| 5,797,520 | A | | 8/1998 | Donahue | |
| 5,806,711 | A | * | 9/1998 | Morano et al. | 221/33 |
| 5,816,501 | A | * | 10/1998 | LoPresti et al. | 239/302 |
| 5,938,016 | A | * | 8/1999 | Erdtmann | 206/221 |
| 6,092,740 | A | * | 7/2000 | Liu | 239/346 |
| 6,302,445 | B1 | | 10/2001 | Kugele et al. | |
| 6,536,687 | B1 | | 3/2003 | Navis et al. | |
| 6,588,681 | B2 | * | 7/2003 | Rothrum et al. | 239/328 |
| 6,595,441 | B2 | * | 7/2003 | Petrie et al. | 239/345 |
| 6,663,018 | B2 | | 12/2003 | Rothrum et al. | |
| 6,698,670 | B1 | * | 3/2004 | Gosis et al. | 239/376 |
| 6,752,179 | B1 | | 6/2004 | Schwartz | |
| 6,796,514 | B1 | | 9/2004 | Schwartz | |
| 6,820,824 | B1 | * | 11/2004 | Joseph et al. | 239/346 |
| 6,938,836 | B2 | | 9/2005 | Bouic et al. | |
| 6,942,126 | B2 | | 9/2005 | Douglas et al. | |
| 6,953,155 | B2 | | 10/2005 | Joseph et al. | |
| 7,159,734 | B1 | * | 1/2007 | O'Brien | 220/495.07 |
| 7,172,139 | B2 | * | 2/2007 | Bouic et al. | 239/345 |
| 7,380,680 | B2 | * | 6/2008 | Kosmyna et al. | 220/23.87 |
| 2003/0209573 | A1 | | 11/2003 | Bouic | |
| 2004/0016825 | A1 | | 1/2004 | Petrie et al. | |
| 2004/0084553 | A1 | | 5/2004 | Joseph et al. | |
| 2004/0118941 | A1 | | 6/2004 | Joseph et al. | |
| 2004/0140373 | A1 | | 7/2004 | Joseph et al. | |
| 2004/0164182 | A1 | | 8/2004 | Joseph et al. | |
| 2004/0217201 | A1 | * | 11/2004 | Ruda | 239/376 |
| 2004/0256484 | A1 | | 12/2004 | Joseph et al. | |
| 2004/0256485 | A1 | * | 12/2004 | Joseph et al. | 239/302 |
| 2005/0029285 | A1 | * | 2/2005 | Gay et al. | 222/1 |
| 2005/0067502 | A1 | | 3/2005 | Bouic et al. | |
| 2005/0145718 | A1 | | 7/2005 | Blette et al. | |
| 2005/0145723 | A1 | | 7/2005 | Blette et al. | |
| 2005/0145724 | A1 | | 7/2005 | Blette et al. | |
| 2005/0263614 | A1 | * | 12/2005 | Kosmyna et al. | 239/345 |
| 2005/0279748 | A1 | * | 12/2005 | Kosmyna | 220/495.02 |
| 2006/0017286 | A1 | * | 1/2006 | Kosmyna et al. | 285/305 |
| 2006/0151630 | A1 | * | 7/2006 | Joseph et al. | 239/346 |
| 2008/0054087 | A1 | * | 3/2008 | Joseph et al. | 239/11 |
| 2009/0072050 | A1 | * | 3/2009 | Ruda | 239/345 |

FOREIGN PATENT DOCUMENTS

| | | | |
|---|---|---|---|
| DE | 298 25 119 | U1 | 3/2005 |
| DE | 298 25 120 | U1 | 3/2005 |
| EP | 0847809 | | 6/1998 |
| EP | 0954381 | A1 | 7/1998 |
| EP | 1 210 181 | B1 | 2/2001 |
| EP | 1 366 823 | A1 | 12/2003 |
| EP | 1 415 719 | A1 | 5/2004 |
| EP | 1 435 265 | A2 | 7/2004 |
| EP | 1 579 922 | A1 | 9/2005 |
| WO | WO 95/07762 | | 3/1995 |
| WO | WO 03/006170 | | 1/2003 |
| WO | WO 03/045575 | | 6/2003 |
| WO | WO 2004/037432 | | 5/2004 |
| WO | WO 2004/037433 | | 5/2004 |
| WO | WO 2004/060574 | | 7/2004 |
| WO | WO 2004/060575 | | 7/2004 |
| WO | WO 2004/094072 | | 11/2004 |
| WO | WO2006/065850 | | 6/2006 |

* cited by examiner

LIQUID CONTAINER SYSTEM FOR A SPRAY GUN

This application claims priority from U.S. provisional patent application Ser. No. 60/668,695, filed Apr. 6, 2005, entitled "Liquid Container System for a Spray Gun", the disclosure of which application is incorporated herein by reference; this application also claims priority from U.S. provisional patent application Ser. No. 60/638,949, filed Dec. 23, 2004, entitled "Liquid Container with Lid and Disposable Liner," which application is incorporated herein by reference; and this application also claims priority from U.S. provisional patent application Ser. No. 60/636,675, filed Dec. 16, 2004, entitled "Liquid Container with Lid and Disposable Liner," which application is incorporated herein by reference.

BACKGROUND

Spray guns are widely used for rapidly coating surfaces with liquids, such as paint. Liquid is contained in a container that attaches to the gun. The outlet of the container is typically a threaded coupling that connects to a corresponding threaded connector on the spray gun. Liquid flows from the container into the spray gun and is fed to a spray nozzle. The spray nozzle combines the liquid with compressed air, atomizing the liquid, forming a spray. At the end of the spraying operation, the container and the mating connection to the spray gun must be thoroughly cleaned so that liquid from one operation does not contaminate the liquid to be sprayed in the next spraying operation. Additionally, the coupling between container and spray gun must not retain any dried liquid that might interfere with the connection between container and spray gun. A container with a disposable liner and lid may be used advantageously to eliminate or reduce the labor required to clean the container and the coupling to the spray gun. A spray gun system with a disposable liner is described in U.S. Pat. No. 6,820,824 to Joseph et al. Other spray gun systems with liners are described in U.S. Pat. No. 3,432,104 to Kaltenbach; U.S. Pat. No. 4,151,929 to Sapien; and U.S. Pat. No. 5,816,501 to Lopresti.

SUMMARY OF THE INVENTION

In a first embodiment of the invention, a three piece liquid container system is provided. The system includes an outer cup, a disposable, collapsible liner for insertion into the outer cup and a removable lid that fits tightly into an opening in the liner. The liner is inserted into the cup and liquid is poured into the liner. The lid includes tabs on its periphery that mate with rib segments on the inside of an opening of the outer cup. The lid is inserted into the liner and then rotated to secure the lid/liner to the cup. The lid can include locking tabs that prevent the lid from rotating in reverse.

In other embodiments of the invention, the cup may include features, such as faceted sidewalls and protrusions on its inside bottom surface, that prevent close contact between the collapsible liner and the cup. These features facilitate complete expulsion of liquid from the liner during spraying. In certain other embodiments of the invention, an adapter is provided to connect the reservoir to the spray gun inlet port without requiring rotation of the reservoir relative to the adapter or the spray gun. The adapter may be secured to an outlet port of the lid by a removable collar, preferably threaded for screwing engagement.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal. Thus, the lid-ring-liner assembly may be removed from the outer cup as a liquid-tight unit. When the lid is installed on the mounting ring, the lid-ring-liner assembly may be secured to the outer cup with a locking mechanism.

In another embodiment of the present invention, a liquid container lid assembly for a spray gun is provided. The assembly includes a lid with a liquid outlet and a generally cylindrical adapter. One end of the adapter connects to the spray gun liquid inlet port and the other end connects to a liquid outlet in the lid. The adapter ends are joined by a liquid-tight passageway. A collar releasably attaches the adapter to the lid by rotation of the collar with respect to the lid.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In broad overview, in various embodiments of the invention, a liquid container system is provided for attachment to a spray gun. The system includes an outer cup, a disposable, collapsible liner for insertion into the outer cup and a removable lid that fits into an opening in the liner.

In certain embodiments of the present invention, a three piece liquid container system is provided. The system includes an outer cup, a disposable, collapsible liner for insertion into the outer cup and a removable lid that fits tightly into an opening in the liner. The liner is inserted into the cup and liquid is poured into the liner. The lid includes tabs on its periphery that mate with rib segments on the inside of an opening of the outer cup. The lid is inserted into the liner and then rotated to secure the lid/liner to the cup. The lid can include locking tabs that prevent the lid from rotating in reverse.

In other embodiments of the invention, the cup may include features, such as faceted sidewalls and protrusions on its inside bottom surface, that prevent close contact between the collapsible liner and the cup. These features facilitate complete expulsion of liquid from the liner during spraying. In certain other embodiments of the invention, an adapter is provided to connect the reservoir to the spray gun inlet port without requiring rotation of the reservoir relative to the adapter or the spray gun. The adapter may be secured to an outlet port of the lid by a removable collar.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal. Thus, the lid-ring-liner assembly may be removed from the outer cup as a liquid-tight unit. When the lid is installed on the mounting ring, the lid-ring-liner assembly may be secured to the outer cup with a locking mechanism.

Figure 1:
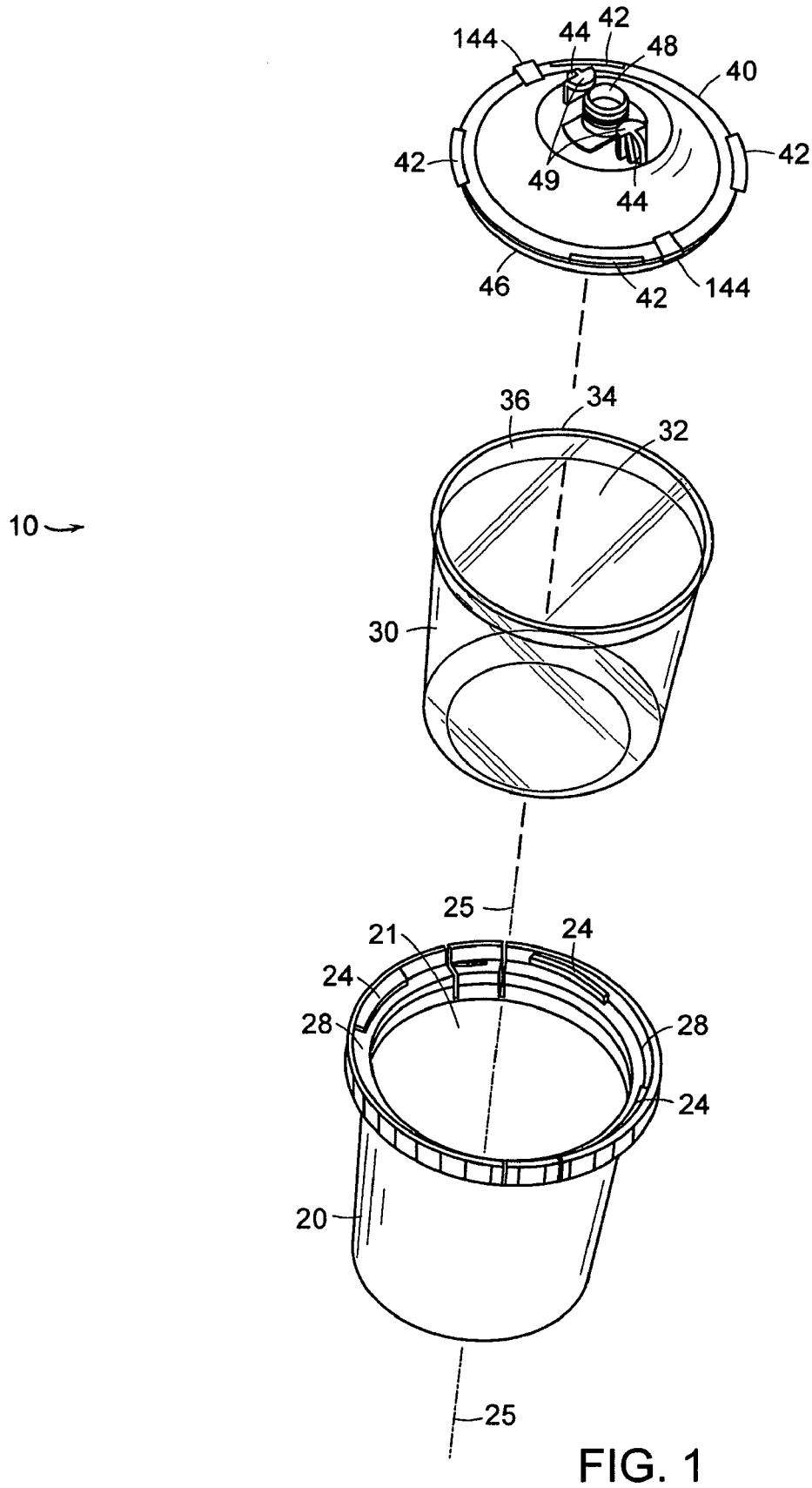
FIG. 1 shows a liquid container system according to an embodiment of the invention.

FIG. 1 shows a liquid container 10 according to an embodiment of the present invention. An outer cup 20 that is made of a relatively stiff material, such as a polymeric material, provides structural stability. The cup 20 is open at one end and is generally cylindrical in shape. The cup includes at least one opening in its bottom or sidewall to allow atmospheric pressure to equalize between the inside and outside of the cup 20. The inside of the cup opening 21 includes rib segments 24 that extend inwardly from the inner wall of the cup. These rib segments 24 are generally perpendicular to the axis 25 of the container 20 and may be pitched slightly downwardly toward the closed end of the cup to act as screw threads for securing the lid to the cup. The outside of the opening of the cup can include a series of tabs 22 that project radially outwardly from the sidewall of the cup. These tabs may be used to grip the cup 20.

Figure 2:
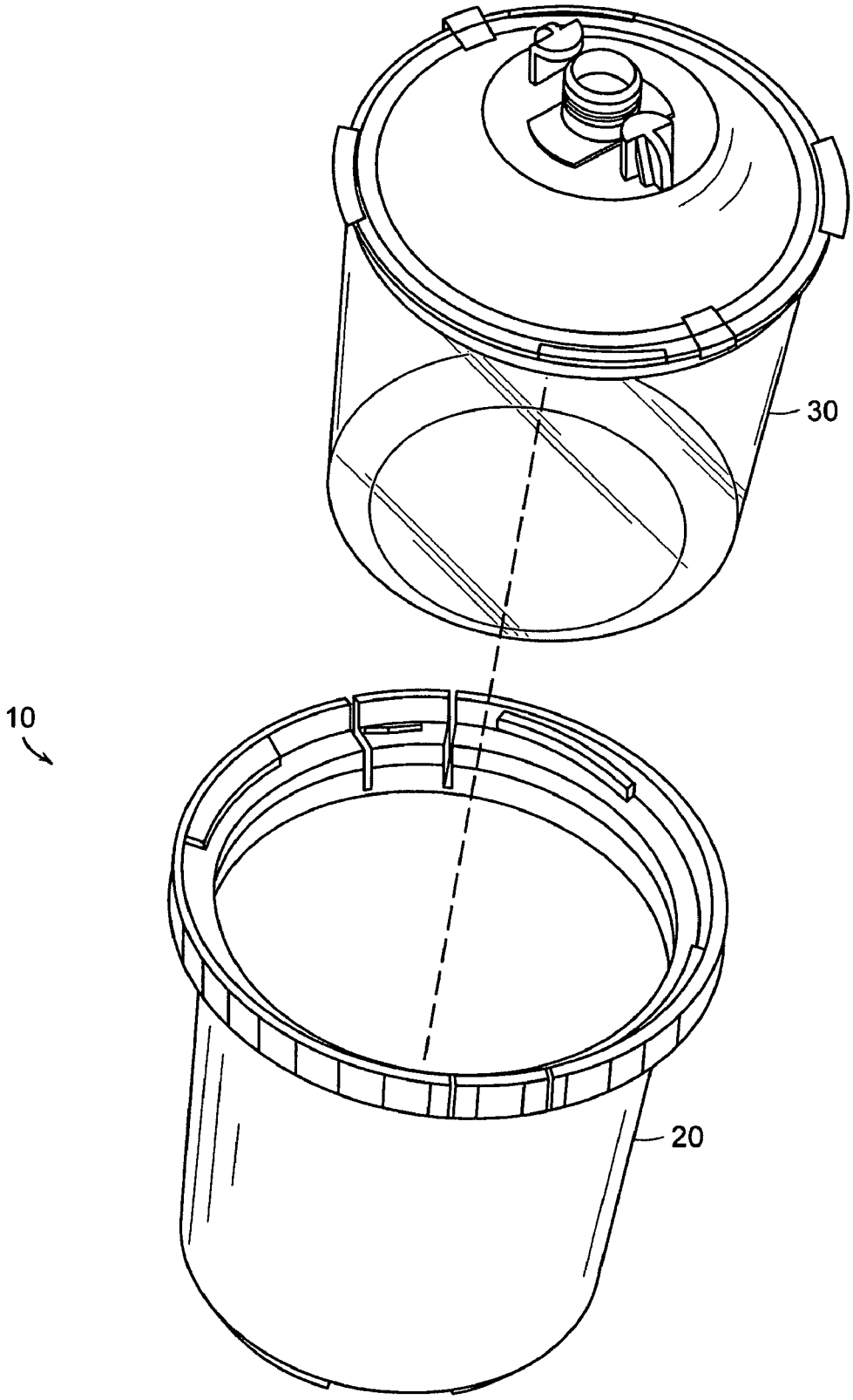
FIG. 2 shows the liner of the liquid container system of FIG. 1 aligned for insertion into a cup.

A disposable liner 30 is provided for insertion into the cup 20. The liner is closed at one end and open at the other end 32. The liner may be made of a thin polymeric material so that the liner can collapse as liquid is removed from the liner, forming a partial vacuum at the top of the liner. The liner may also be stiff enough that the liner can hold its shape while empty or filled. In one embodiment, the thickness of the liner bottom to the liner sidewalls is approximately 1:1 and the sidewalls and bottom have comparatively similar rigidity. Further embodiments provide a base thinner than the sidewalls to promote an inward collapse of the liner during spraying. The liner 30 may include a lip 34 at the open end. The lip 34 can rest upon a flange 28 on the inside of the cup so that liquid may be poured into the opening of the liner without collapsing the liner into the cup. In some embodiments of the invention, the liner is a close fit to the interior of the cup. FIG. 2 shows the liner 30 aligned for insertion into the cup 20.

A lid 40 is provided for insertion into the opening 32 in the liner 30. The lid 40 is adapted to contain paint or other liquid within the liner and to prevent air from entering the closed lid/liner combination. The lid includes an outlet 48 to allow liquid to flow from the container. In some embodiments of the invention, the lid 40 fits sufficiently tightly into the liner opening 32 that the lid/liner combination may be removed as a unit from the cup, after the liquid has been substantially removed from the liner. For example, the lid can have a cylindrical retaining wall 46 for making a frictional fit with the liner. This cylindrical retaining wall may include an outward facing rib. When pressed together, the liner fits tightly around the retaining wall to hold the liner and lid together. Alternatively, the cylindrical retaining wall may include an inward groove and the liner can have a mating inward rib that snaps or pushes into the groove to hold the liner to the lid. In some embodiments, the lid has at least two tabs 42 extending from its periphery. When the lid is inserted into the opening of the cup and rotated, these tabs mate with the rib segments described above, and secure the lid/liner combination into the cup. Either one or both of the tabs and rib segments may be angled so that rotation of the lid with respect to the cup screws the lid into the cup. Reversing this process allows the lid/liner combination to be extracted from the cup. The lid may be provided with tabs 44 that assist in rotating the lid to mate with the cup. The lid may also have a retaining structure, such as hooks 49, to assist in securing the lid to a spray assembly.

Figure 3:
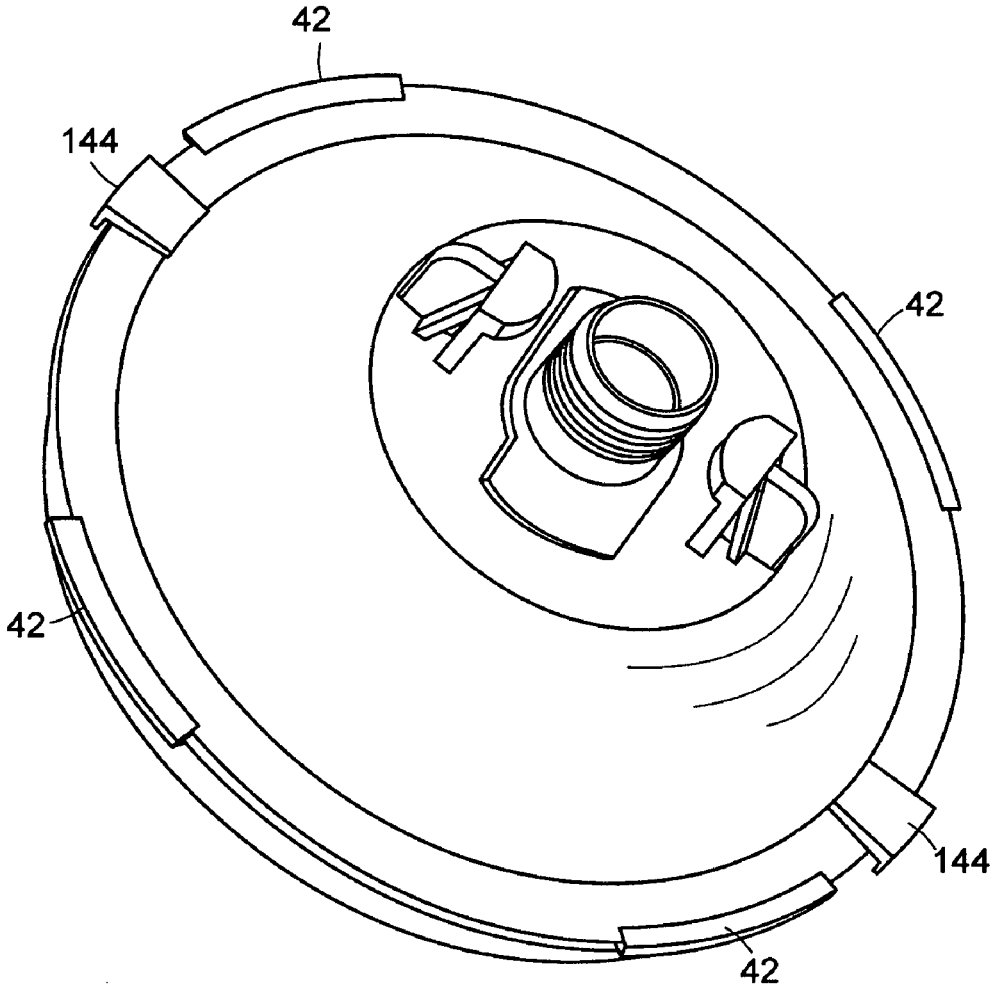
FIG. 3 illustrates a locking tab that extends from the periphery of the lid of the liquid container system of FIG. 1.
Figure 4:
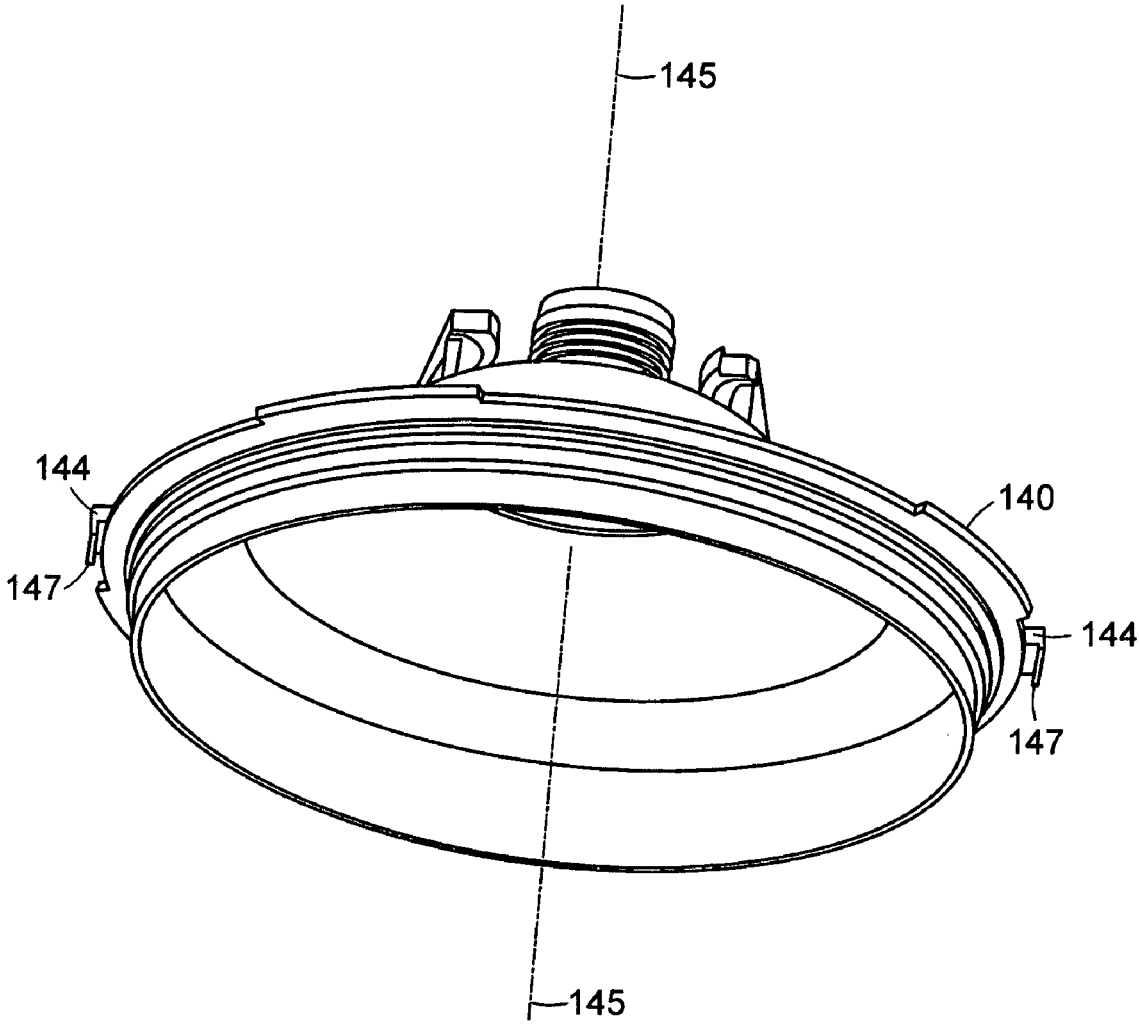
FIG. 4 shows a perspective view of the bottom of the lid of the liquid container system of FIG. 1.
Figure 5:
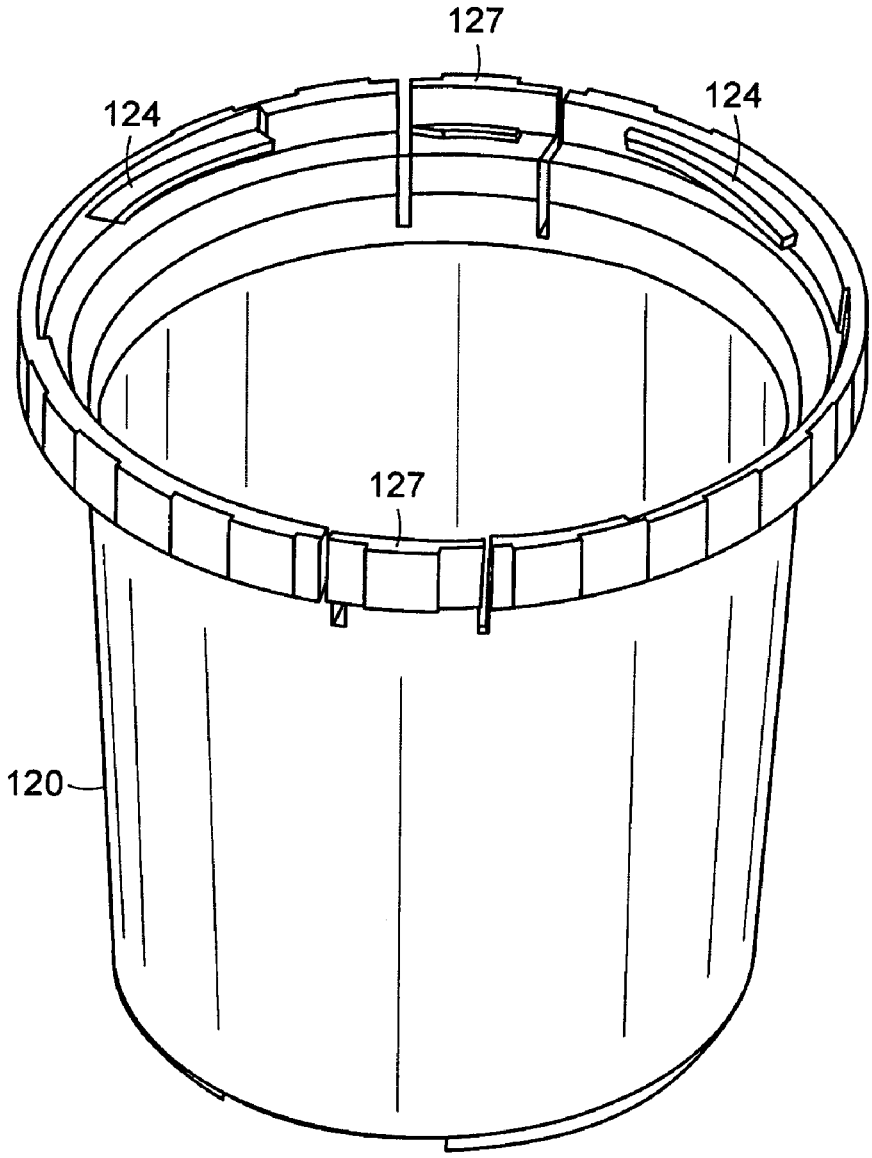
FIG. 5 shows a perspective view of the cup of the liquid container system of FIG. 1.
Figure 6:
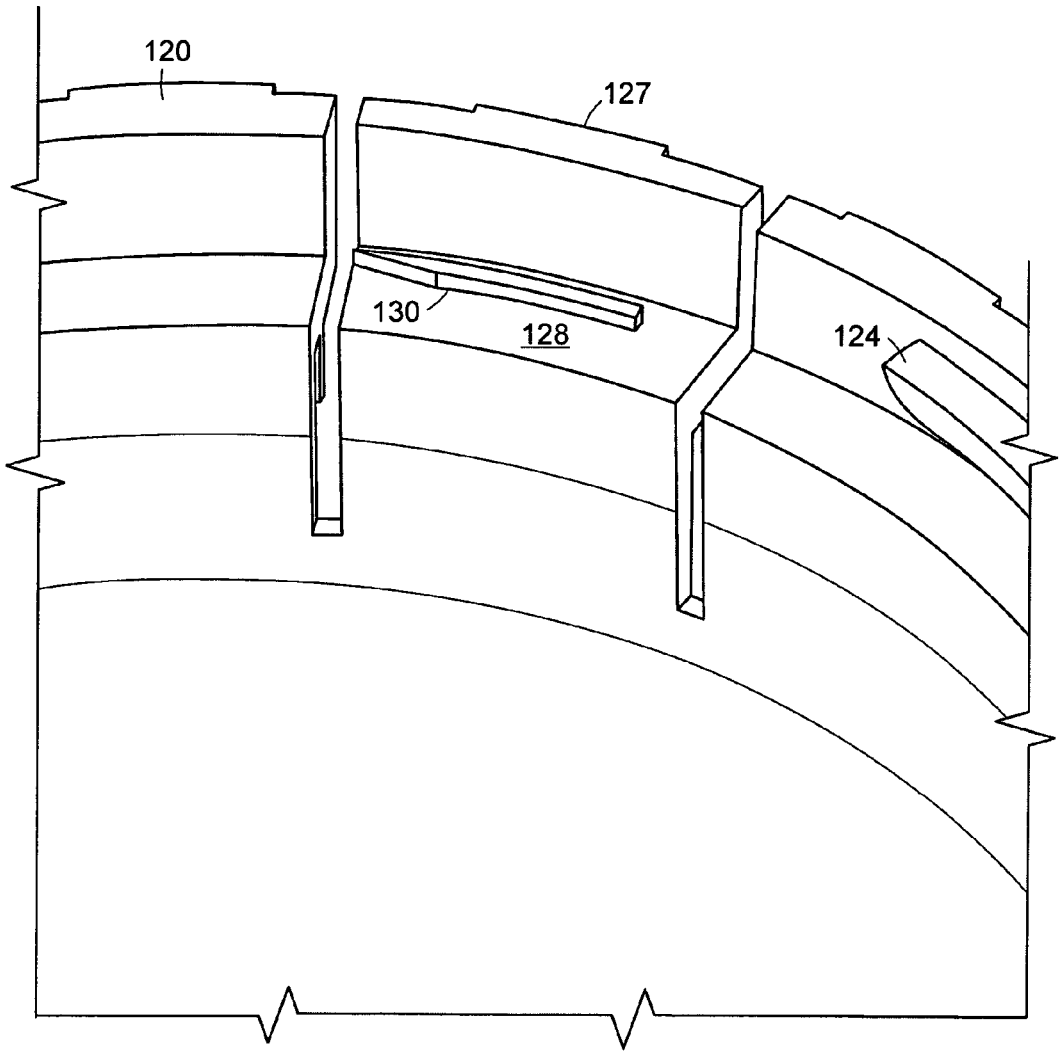
FIG. 6 shows a close-up of pinch segments of the cup of the liquid container system of FIG. 1.

In further specific embodiments of the invention, according to any of the embodiments described above, a locking mechanism prevents the lid from rotating relative to the cup in reverse. At least one locking tab 144 is provided that extends radially from the periphery of the lid 140, as shown in FIG. 3. FIG. 4 shows a perspective view of the bottom of the lid 140. Locking tab 144 includes a lead 147 that is substantially parallel to the axis 145 of the lid 140. FIG. 5 shows a perspective view of the cup 120. At least one pinch segment 127 is formed in the opening of the cup. Each pinch segment 127 includes slots cut on either side so that the pinch segments 127 can deflect radially. As shown in FIG. 6, the pinch segments 127 include an extension rib 130 on the cup's flange 128. The extension rib 130 is tapered at one end. When the lid 140 is inserted into the cup opening and rotated clockwise, the lid's locking tab lead deflects the pinch segment 127 radially outwardly. Outward deflection of the pinch segment 127 is facilitated by the taper on the extension rib 130. As rotation continues and the locking tab lead clears the extension rib, the pinch segment deflects inwardly, thus preventing the lid from rotating counter-clockwise. The cup's pinch segments 127 can be deflected radially by pinching. This action frees the lid's locking tab lead 147 from the extension rib, allowing the lid to be rotated counter-clockwise and removed.

Figure 7:
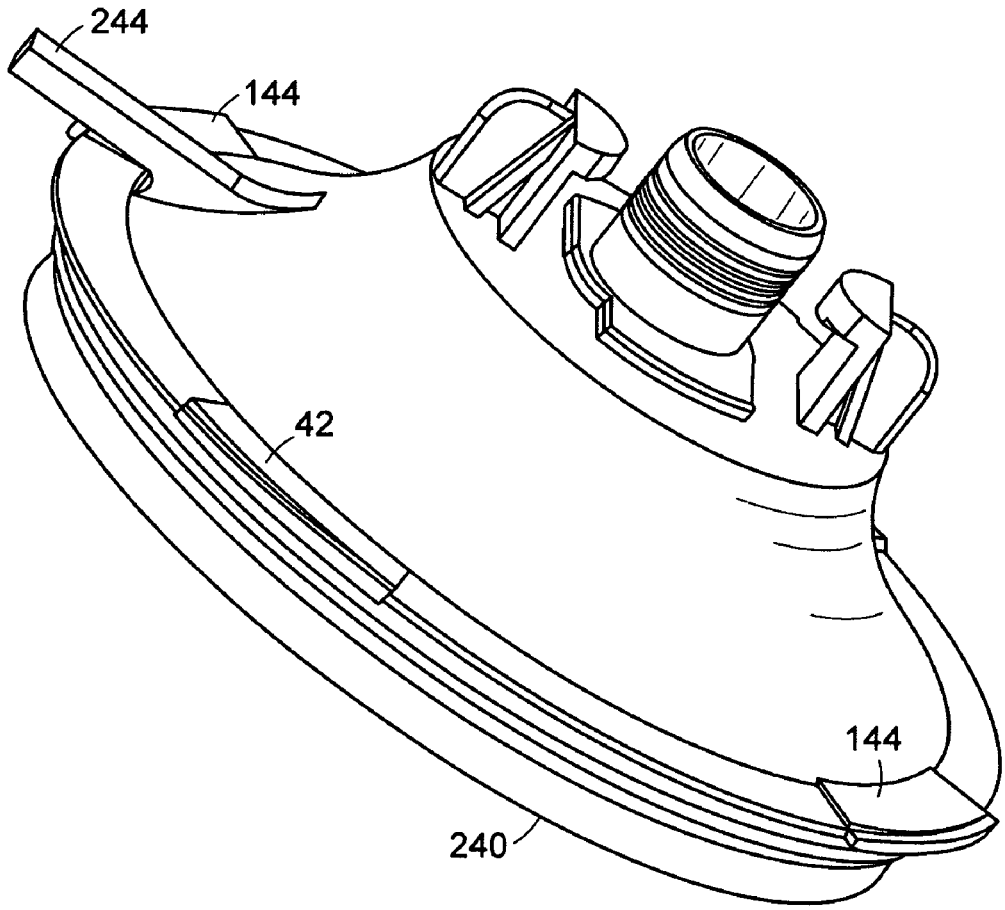
FIG. 7 illustrates, in another embodiment of the invention, an alternative locking mechanism, to prevent the lid from rotating relative to the cup.
Figure 8:
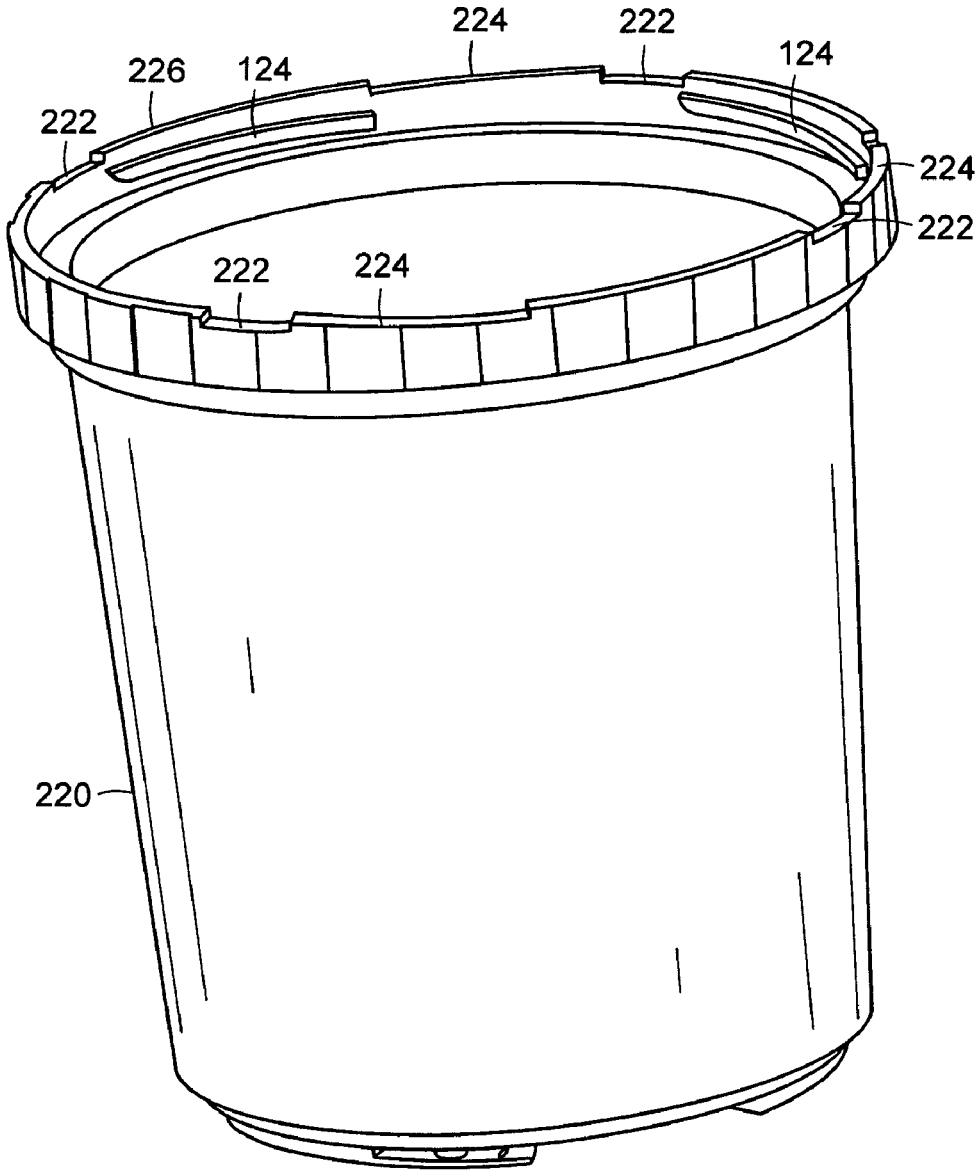
FIG. 8 shows a perspective view of the corresponding cup for the lid of FIG. 7.

In another embodiment of the invention, an alternative locking mechanism is provided for the lid, to prevent the lid from rotating relative to the cup. FIG. 7 shows a perspective view of lid 240 that includes a locking finger 244. The locking finger 244 extends radially outwardly from the periphery of the lid 240. FIG. 8 shows a perspective view of the corresponding cup 220. The cup includes at least one slot 222 cut into the rim 226 of the opening of the cup. Adjacent to the slot 222 on the rim 226 is a ramp 224 that inclines upwardly towards the slot. When the lid 240 is inserted into the cup opening and rotated clockwise, the lid's locking finger deflects upward. Upward deflection of the locking finger 244 is facilitated by the incline on the ramp 224. As rotation continues and the locking finger 244 clears the leading edge of the slot 222, the locking finger deflects downwardly into the slot 222. The locking finger 244 prevents the lid from rotating counter-clockwise. To remove the lid, the locking finger can be manually deflected upwardly and the lid rotated. This action frees the lid's locking finger from the slot, allowing the lid to be rotated counter-clockwise and removed.

Figure 9:
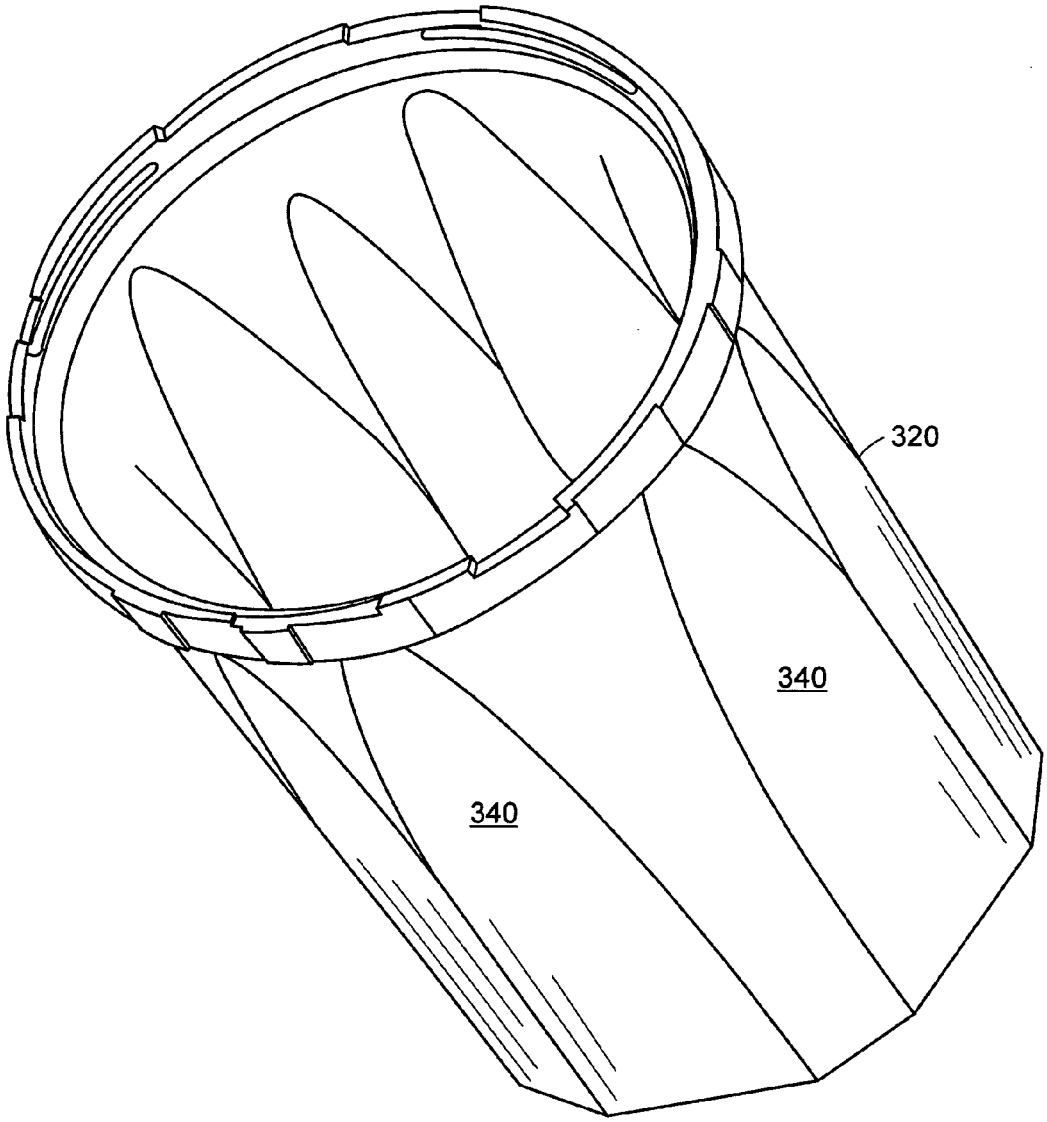
FIG. 9 illustrates a faceted outer cup according to an embodiment of the invention.
Figure 10:
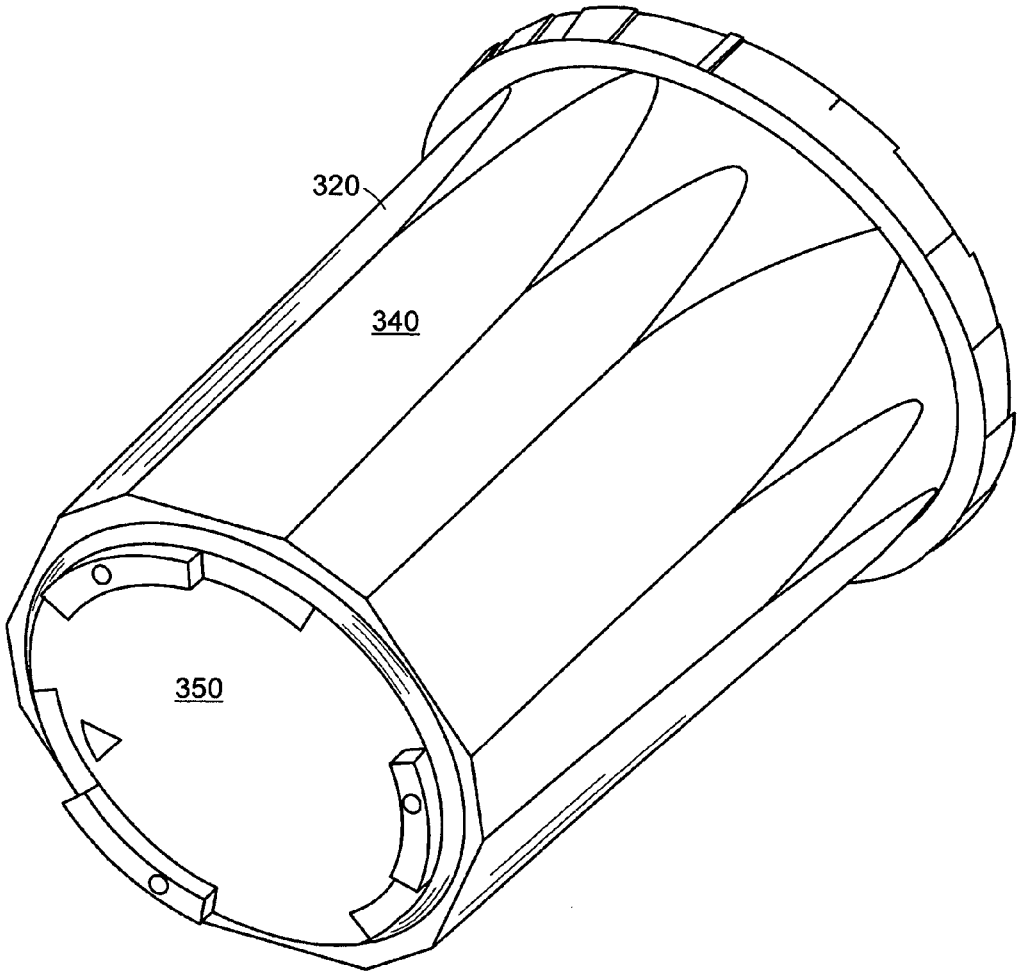
FIG. 10 shows a bottom, perspective view of the cup of FIG. 9.
Figure 11:
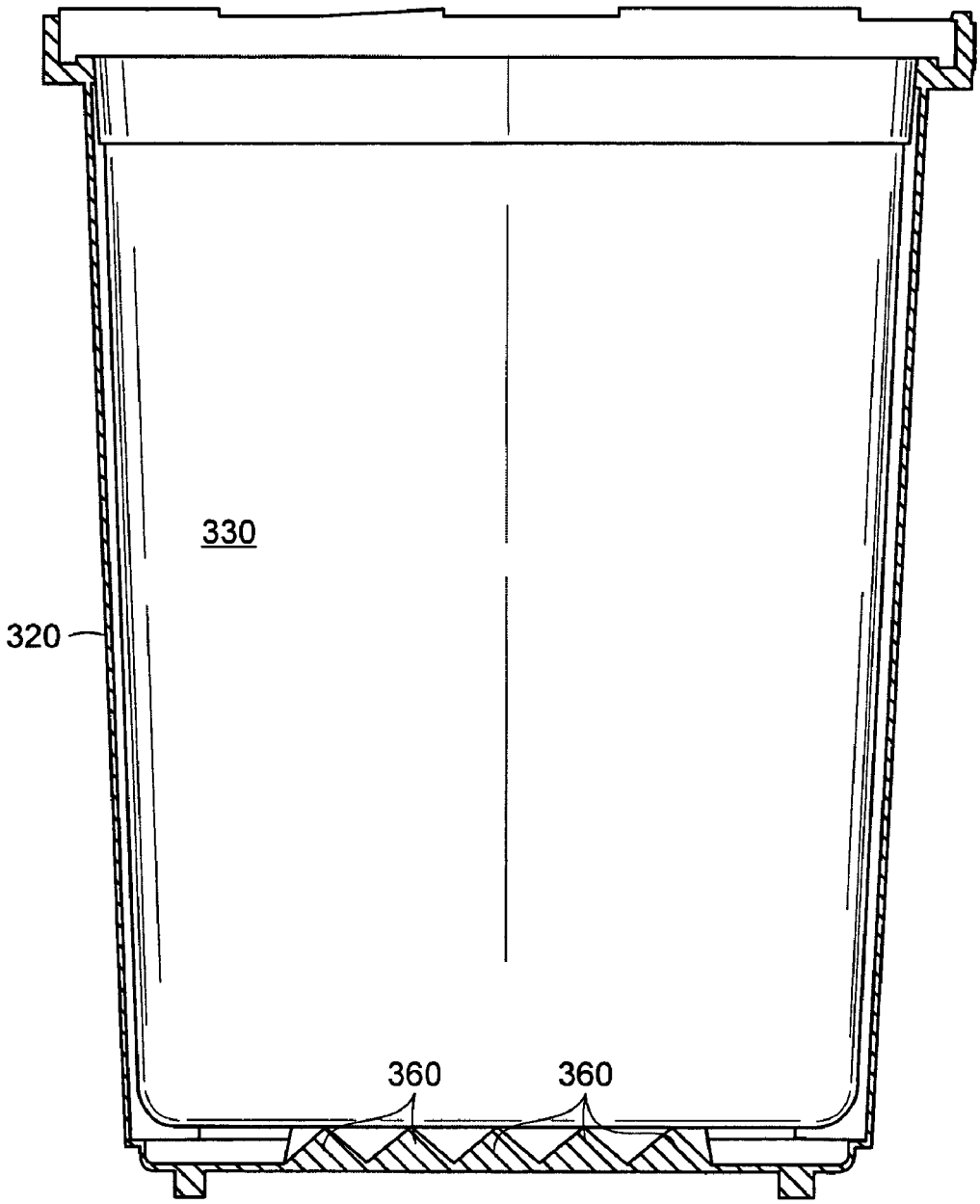
FIG. 11 shows an interior side-view of a cup according to an embodiment of the invention.

In other embodiments of the invention, an outer cup 320, shaped as shown in FIG. 9, may be employed in any of the embodiments of the invention. The cup 320 includes one or more facets 340 in its sidewall. The facets 340 may extend substantially the length of the sidewall or any portion thereof. FIG. 10 shows another view of the outer cup 320, including its bottom surface 350. The outer cup 320 may also be provided with protrusions 360 on the interior of its bottom surface 350, as shown in FIG. 11. The protrusions may be of any shape or length and may cover any portion of the interior surface of the cup bottom. In preferred embodiments, the protrusions are ridges, the length of the ridges is a small fraction of the cup height and the ridges cover less than 50% of the interior surface of the cup bottom. Alternatively, the protrusions may be pyramidal or teeth-like in shape or otherwise shaped to support the liner above the cup bottom. A collapsible liner 330 that is stiff enough to stand on its own, either empty or filled, is inserted into the cup. Such a liner will not conform to the interior sidewall or bottom surface of the cup. Thus, any tendency of the liner to cling to the cup will be overcome and liquid may be more completely withdrawn from the liner during spraying.

Figure 12:
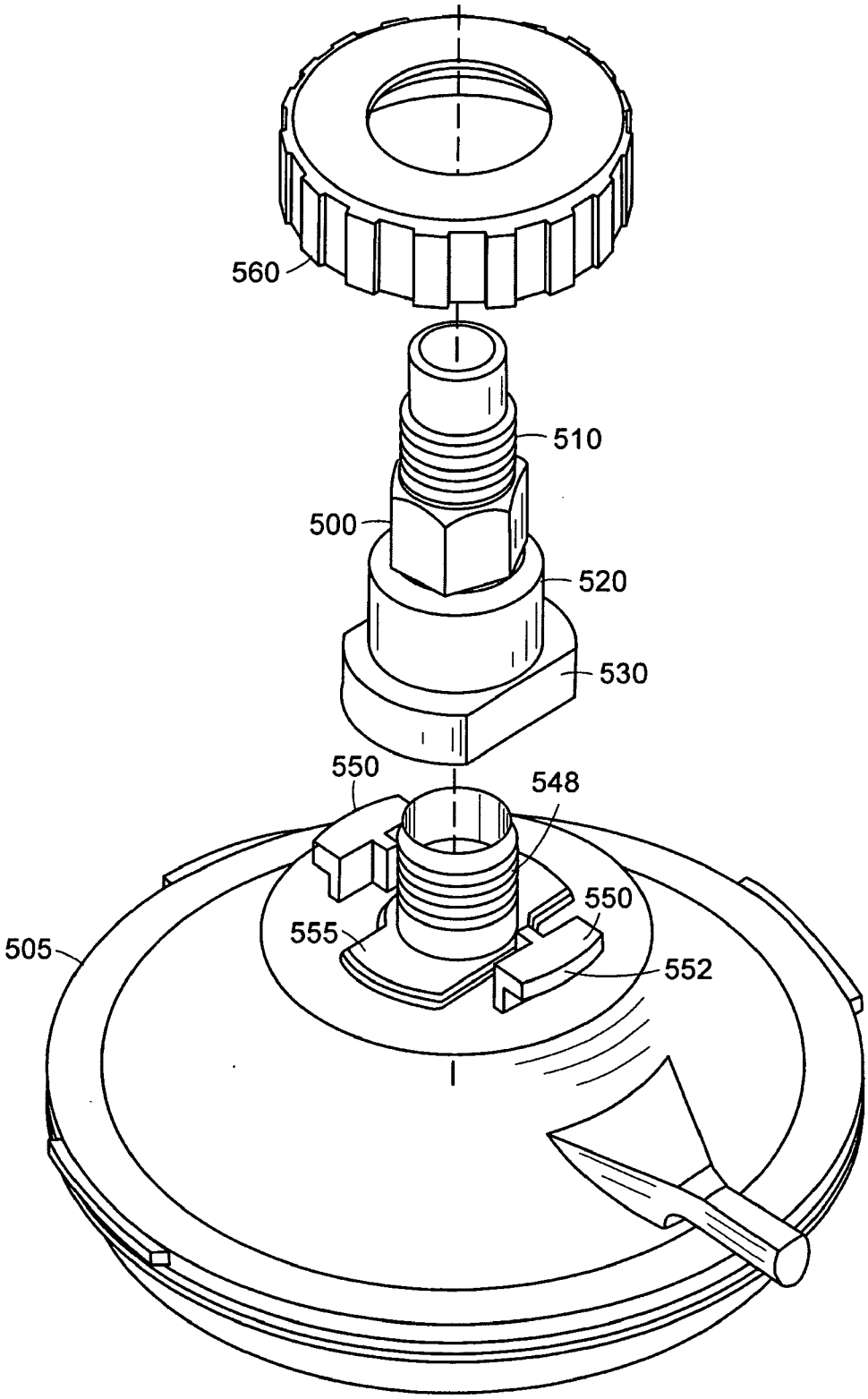
FIG. 12 illustrates a connector system for releasably mating a spray gun with a liquid reservoir, according to an embodiment of the invention.
Figure 13:
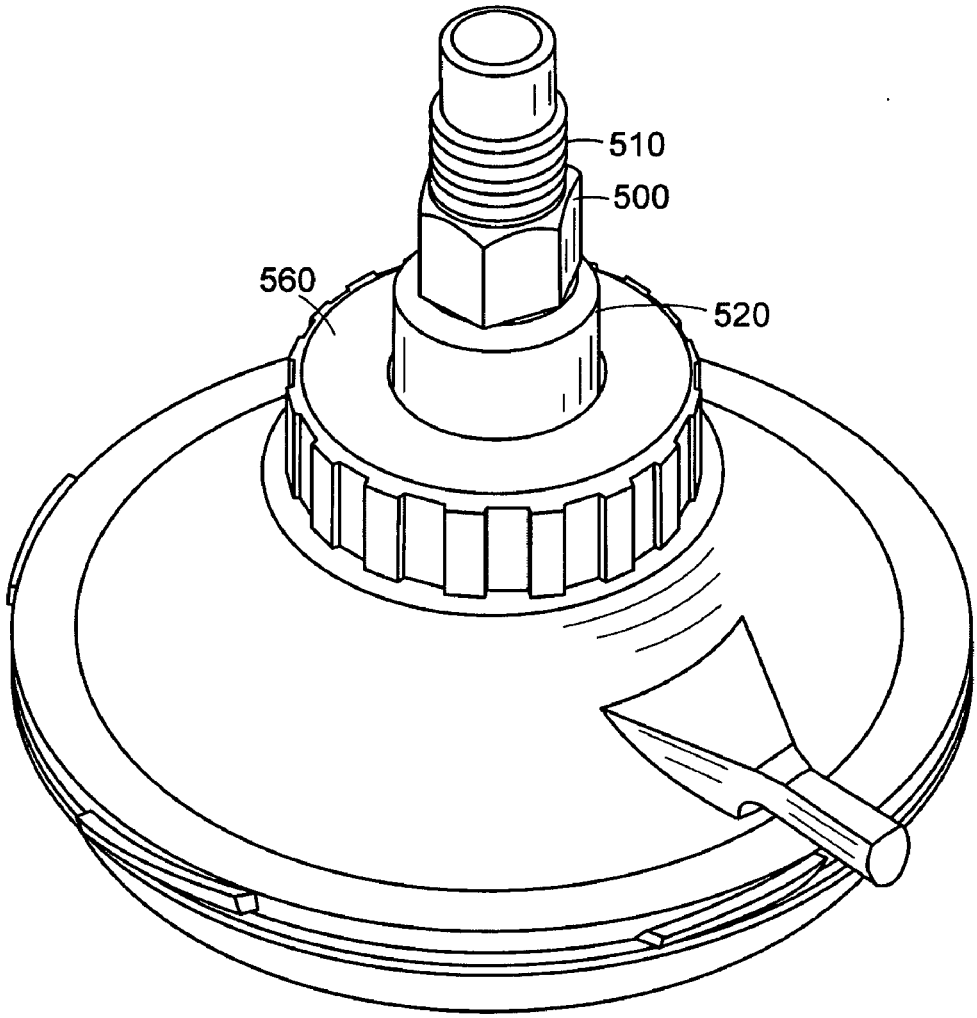
FIG. 13 shows an adapter secured to the lid by a collar for the embodiment of FIG. 12.

In certain other embodiments of the present invention, a connector system is provided for releasably mating a spray gun with a liquid reservoir. For example, without limitation, the connector system may be used with any of the liquid reservoirs shown in the figures of the present application. A removable lid 505 is provided for the reservoir, as shown in FIG. 12. The lid has an outlet 548 of generally cylindrical shape so that liquid may be transferred from reservoir to spray gun. An adapter 500 of generally cylindrical shape is provided to connect the lid outlet 548 to the spray gun inlet port. The adapter has a threaded spray gun end 510 for insertion into and attachment to the inlet port on the spray gun. The reservoir end of the adapter includes a barrel 520 that receives the lid outlet 548. The spray gun end and the reservoir end of the adapter are connected by a liquid passageway. An adapter flange 530 is provided that surrounds the barrel 520. The lid is provided with at least one projection 550 that includes at least one radially outwardly projecting tab 552 on the projection's outer surface (the surface that is distal to the axis of the lid outlet 548). The reservoir end of the spray gun adapter is seated on the flange 555 surrounding the outlet port 548 of the lid. Flange 530 fits on the lid in only one general position from which rotation is impeded by projections 550. A collar 560 is then placed over the barrel 520 of the adapter and rotated about the axis of the outlet. The projection tab 552 acts as a screw thread for the mating threads on the interior surface of the collar sidewall. Rotation of the collar engages the collar with the top surface of the flange 530 and secures the adapter to the lid. FIG. 13 shows the adapter secured to the lid. Thus, the adapter is secured to the lid without requiring rotation of the reservoir relative to the adapter. This form of connection reduces the need to handle, impart motion to or otherwise disturb filled liquid reservoirs.

Figure 14:
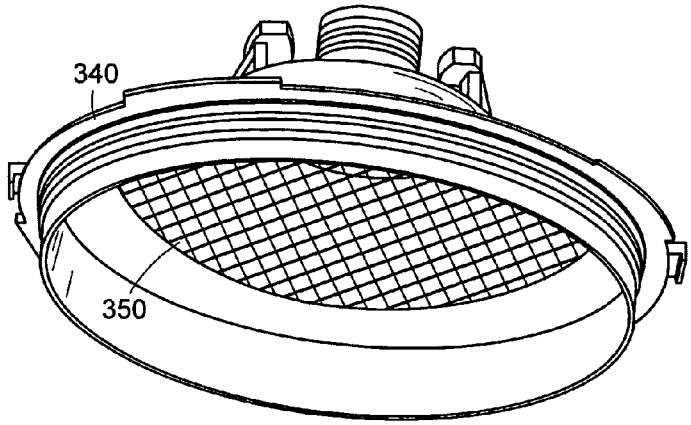
FIG. 14 illustrates a lid with an integral filter according to an embodiment of the invention.

In embodiments of the invention, the liquid container may be coupled with either a gravity feed or a suction feed spray gun, with the outlet of the lid connected to the inlet port of the gun by an adapter, such as the adapter described above. Liquid is withdrawn from the container and fed to the spray nozzle. The gun may be oriented in a wide range of orientations, including an inverted orientation with respect to gravity. In some embodiments of the invention, a filter, which may be removable, may be provided to filter the liquid withdrawn from the container. In one embodiment of the invention, a filter 350 may be built into the underside of the lid 340, as shown in FIG. 14. In various embodiments of the invention, channels are provided on the outside sidewall of the cup into which scales for measuring the liquid poured into the container may be slid.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal when the lid is screwed into the ring. Thus, the lid-ring-liner assembly may be removed from the outer cup as a liquid-tight unit. When the lid is installed on the mounting ring, the lid-ring-liner assembly may be secured to the outer cup with a locking mechanism.

Figure 15A:
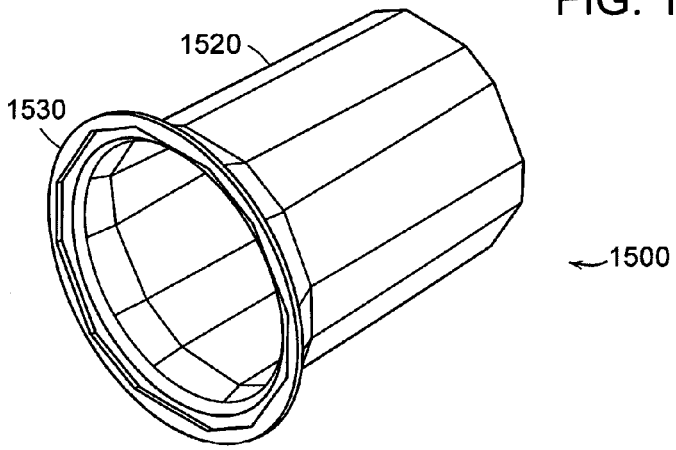
FIGS. 15A-C illustrate an outer cup for a four piece liquid container system, for an embodiment of the invention.
Figure 15B:
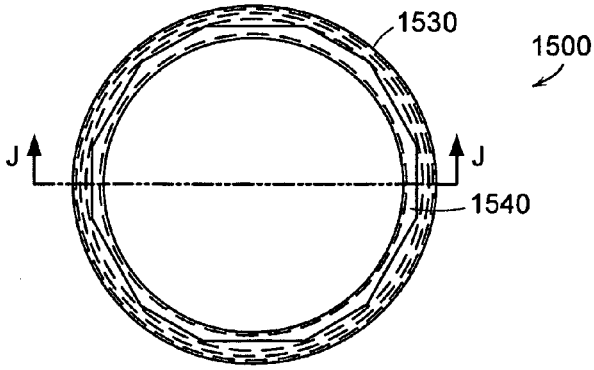
Figure 15C:
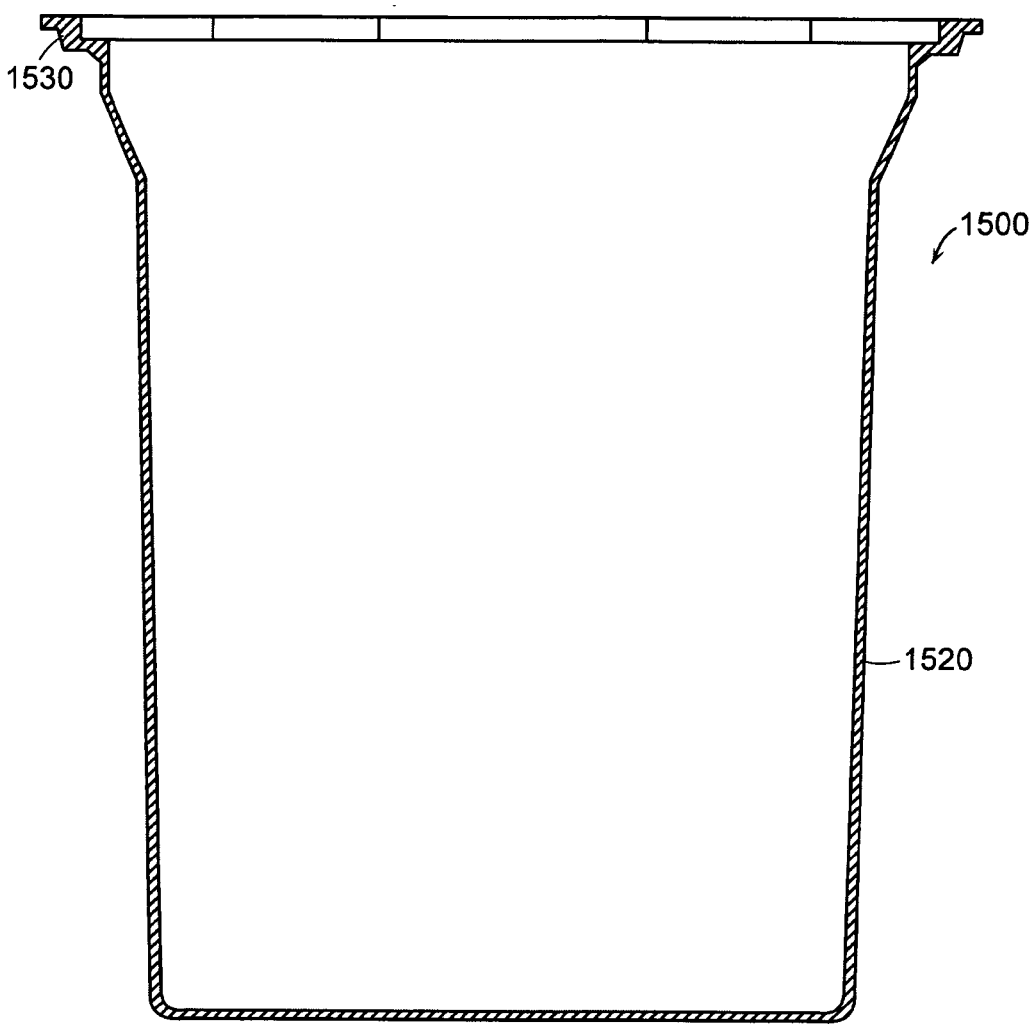

FIG. 15 shows an outer cup 1500, according to an embodiment of the four piece liquid container system. Note that the term "four piece liquid container system" is for convenience in description and not by way of limitation. The system may include other components and some of the identified four pieces of the system can be implemented as more than one component. FIG. 15A shows a perspective view of the outer cup 1500. The cup is generally cylindrically shaped. The outer cup is made of a relatively stiff material, such as a polymeric material, which provides structural stability. In the embodiment shown in FIG. 15A, the outer wall 1520 of the cup includes facets similar to those shown and described in and for FIG. 9. In general, however, the outer wall of the outer cup may be implemented with any generally cylindrical shape. The outside and inside bottom of the cup may be flat or may be other than flat. For example, the inside bottom may include projections, similar to those shown in FIG. 11. The top of the outer cup includes a generally cylindrical lip 1530 that is concentric with the longitudinal axis of the outer cup. FIG. 15B shows a plan view of the cup lip 1530 as viewed from above. The lip 1530 includes a polygonal indentation or recess 1540 in the lip. This recess 1540 receives and supports the mounting ring-liner assembly, as will be described below. While the recess is shown shaped as a twelve-sided polygon, the number of faces on the recess polygon is exemplary only and not by way of limitation. The recess may assume other shapes in other embodiments of the invention, such as an annulus. FIG. 15C shows the outer cup in cross section. In specific embodiments of the invention, the outer cup includes an opening in its bottom or sidewall to prevent vacuum formation and to allow paint to be expelled from the container system.

Figure 16A:
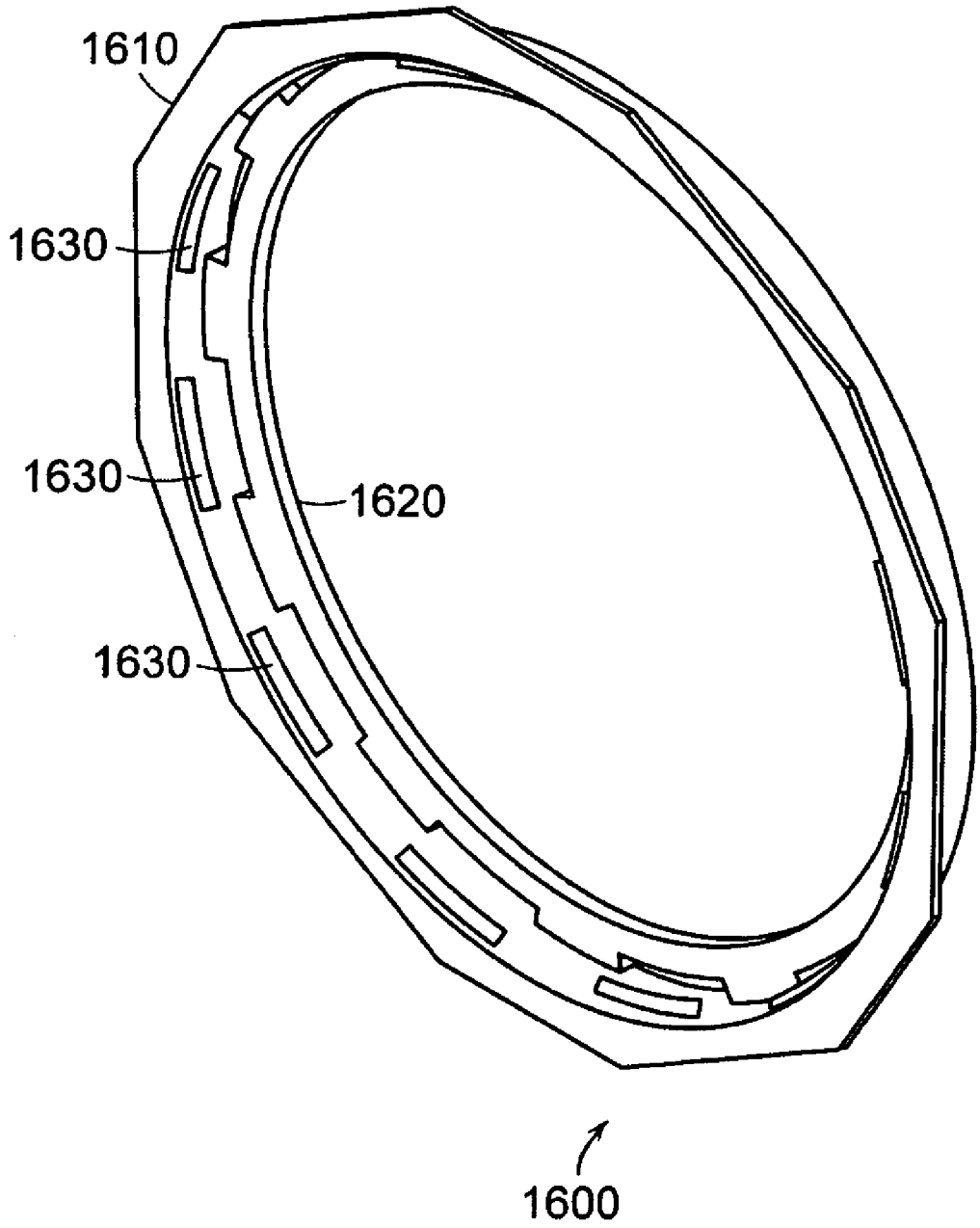
FIGS. 16A-C show a mounting ring for supporting a liner within the outer cup of the embodiment of FIG. 15.
Figure 16B:
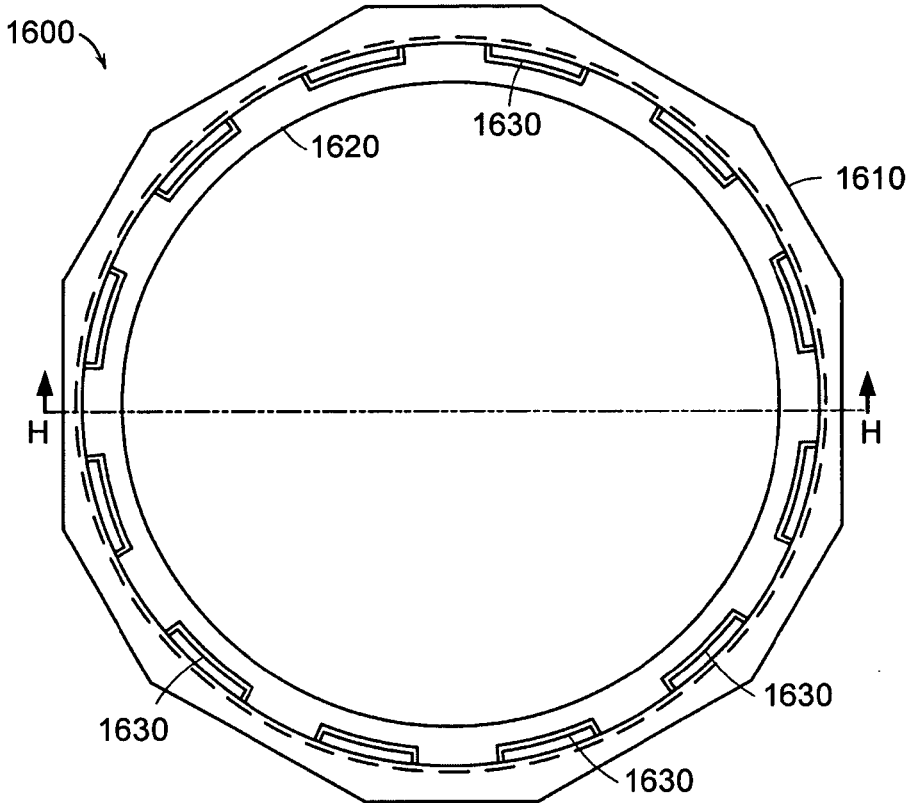
Figure 16C:
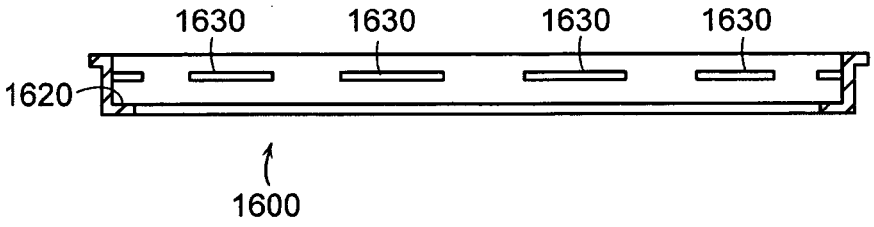

FIGS. 16A-C show a mounting ring 1600, according to an embodiment of the four piece liquid container system. FIG. 16A shows the ring 1600 in a perspective view. The ring is generally annular in shape with the periphery of the annulus shaped to match the recess in the lip of the outer cup. As shown in FIGS. 16A and 16B, the periphery of the ring 1610 is polygonal with twelve sides for insertion into the polygonal recess 1540 in the lip of the outer cup. The polygonal shape is advantageous for the ring in that when inserted into the outer cup, the ring will not rotate. Of course, the shape for the periphery of the ring is exemplary only and may be any shape that corresponds to the recess in the lip of the outer cup. The ring 1600 includes a recess 1620 for receiving and supporting a lip at the open end of the liner, as will be described below. The recess is annular in shape with a circular periphery, but, in general, may assume any shape that corresponds to the shape of the lip of the liner. The inside of the mounting ring includes rib segments 1630 that extend inwardly from the inner wall of the ring. These rib segments 1630 are generally parallel to the plane of the ring 1600 and may be pitched slightly downwardly toward the cup end of the ring to act as screw threads for securing a lid to the ring.

Figure 17:
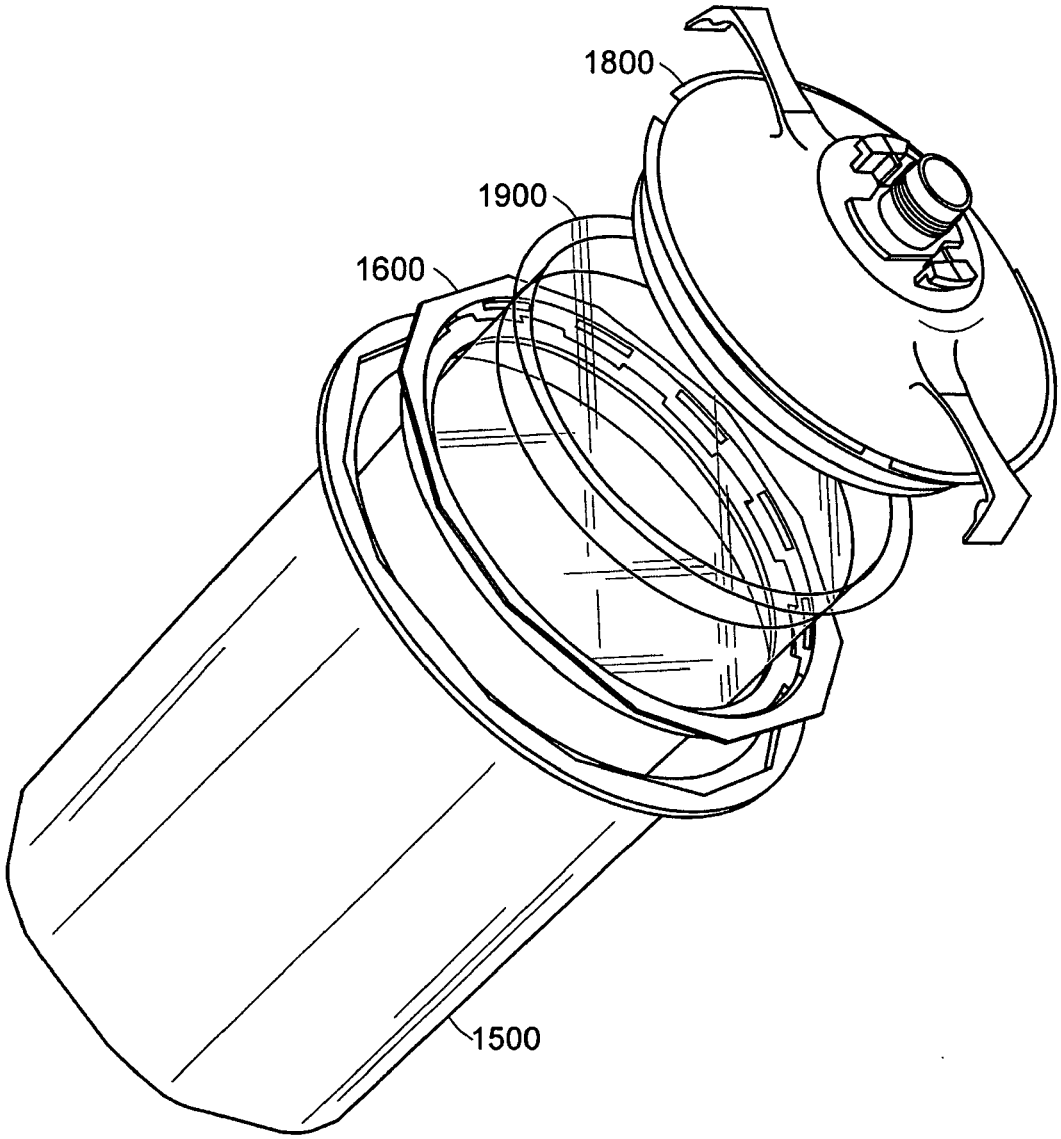
FIG. 17 is an assembly drawing for the liquid container system of FIGS. 15-16.
Figure 18A:
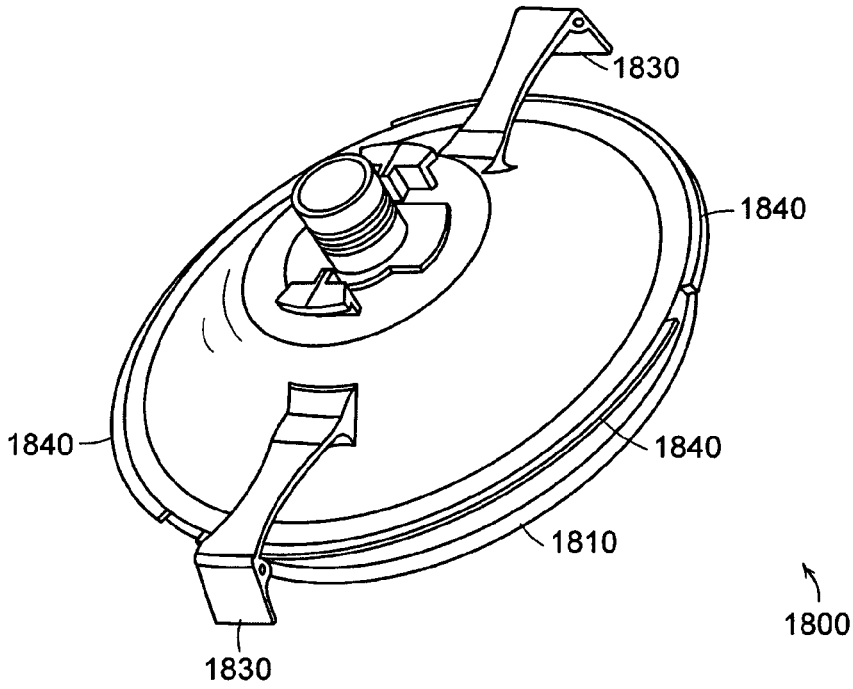
FIG. 18A-B show a removable lid according to an embodiment of the invention that may be used in system of FIG. 17.
Figure 18B:
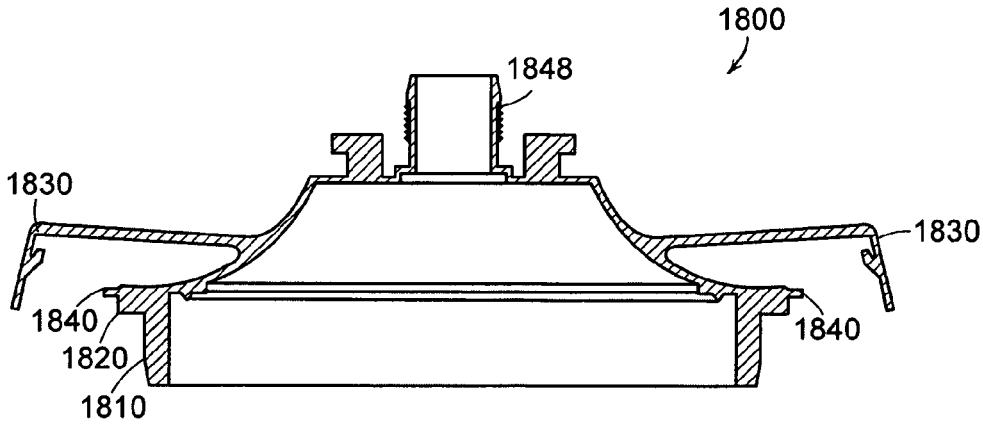
Figure 19:
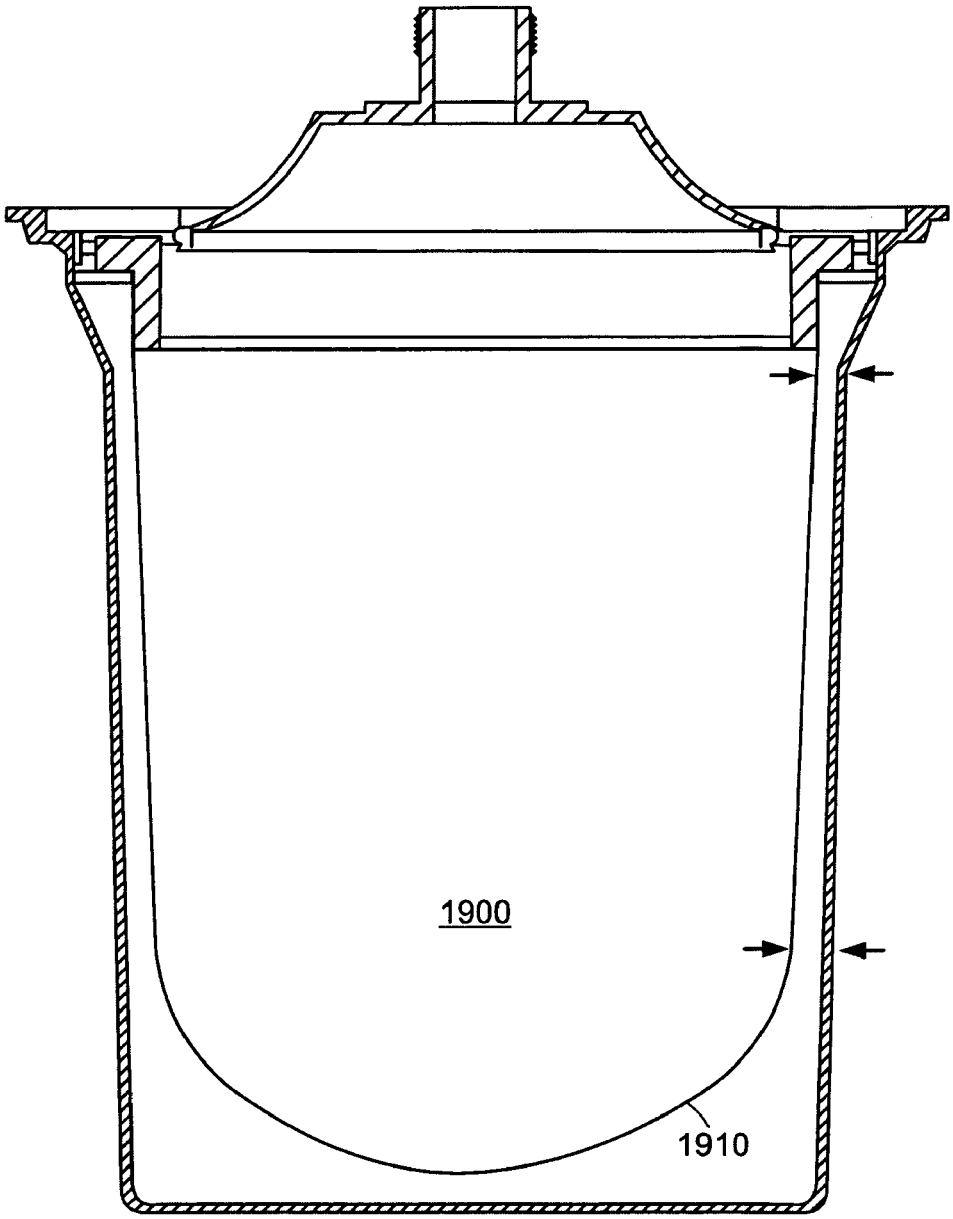
FIG. 19 shows a collapsible liner for use in a liquid container system, according to an embodiment of the invention.

FIG. 17 shows, in perspective, the components that may be included in the four piece liquid container system, according to an embodiment of the invention. The mounting ring 1600 is inserted into the recess in the lip at the open end of the outer cup 1500. A liner 1900 is inserted into the mounting ring, with a lip at the top of the liner resting on the recess 1620 in the mounting ring. While the liner of FIG. 19 is shown, any liner as described in this detailed description may be used in embodiments of the invention. A removable lid 1800, as shown in FIG. 18, includes a bottom projection 1810 that is inserted into the open end of the liner, after liquid has been poured into the liner. The lid 1800 is adapted to contain paint or other liquid within the liner and to prevent air from entering the closed lid/liner combination. The underside of a flange 1820 on the periphery of the lid forces the lip of the liner to the mounting ring recess, forming a seal. In specific embodiments of the invention, the diameter of the lid bottom projection 1810 and the inner diameter of the ring recess 1620 are such that the top of the sidewall of the liner is compressed when the lid is attached to the mounting ring. Compression of the liner sidewall between lid bottom projection 1810 and ring recess 1620 in this embodiment aids in forming a liquid tight seal. The lid bottom projection 1810 and the inner edge of the mounting ring recess 1620 may both be tapered to aid in assembly of the liner, lid and mounting ring. Tabs 1840 at the edge of the lid allow the lid to be screwed into rib segments 1630 on the mounting ring, securing the lid to ring. FIG. 18 shows the tabs 1840 extending the majority of the circumference of the edge of the lid, but shorter tabs will also perform the function. A locking mechanism 1830 on the lid can clamp the lid to the outer cup 1500, allowing the liquid container system to be oriented in any direction without danger of detachment of the outer cup from the system. As illustrated in FIG. 18, the locking tabs 1830 clip over a flange on the outer cup. The tabs may be hinged and biased to snap onto the flange of the outer cup. The lid has an outlet 1848 of generally cylindrical shape so that liquid may be transferred from outer cup to the spray gun. The lid outlet, an adapter for connection to a spray gun that mates thereto and means for securing the adapter to the outlet may be constructed as described above in connection with FIG. 12. Other types of liquid outlets, adapters and means for securing the adapter to the outlet may be employed in other embodiments of the invention. The locking mechanism shown for connecting the lid to the outer cup is by way of example only and a variety of such mechanisms, as are known in the art, may be used to secure the lid to the cup, in various embodiments of the invention.

Any of the liners shown and described above for embodiments of the invention, may be employed in embodiments of the four piece liquid container system. A liner for use in the system, in general, will be:

liquid tight;

collapsible so that liquid may be expelled from the container system; and open-ended with a lip surrounding the open end, so that the lip may be supported by the recess in the mounting ring and the lip may be pressed by the flange 1820 of the removable lid against the ring.

Within these broad outlines, the material used for the liner may vary and the shape of the body of the liner may assume a variety of shapes. For example, the liner body may have pleats and the bottom of the liner body need not be flat. The liner may be made of a thin polymeric material so that the liner can collapse as liquid is removed from the top of the liner, forming a vacuum at the top of the liner. As in other embodiments of the invention, an opening or openings placed in the bottom or side wall of the outer cup allows air to enter the space between liner and cup. The liner may also be stiff enough that the liner can hold its shape while empty or filled. In one embodiment, the thickness of the liner bottom to the liner sidewalls is approximately 1:1 and the sidewalls and bottom have comparatively similar rigidity. Further embodiments provide a base thinner than the sidewalls to promote an inward collapse of the liner during spraying.

In an embodiment of the invention, as shown in FIG. 19, a liner 1900 for use in a liquid container system is provided. The liner has a non-flat bottom 1910, as shown in cross-section in FIG. 19. The liner of the embodiment shown in FIG. 19 includes a bottom that is rounded (approximately hemispherical), but in other embodiments the bottom may be shaped in other ways that are not flat.

In embodiments of the invention, the four piece liquid container may be coupled with either a gravity feed or a suction feed spray gun, with the outlet of the lid connected to the inlet port of the gun by an adapter, such as the adapter described above. Liquid is withdrawn from the container and fed to the spray nozzle. The gun may be oriented in a wide range of orientations, including an inverted orientation with respect to gravity. In some embodiments of the invention, a filter, which may be removable, may be provided to filter the liquid withdrawn from the container. In one embodiment of the invention, a filter 350 may be built into the underside of the lid 1800, similar to the filter arrangement shown in FIG. 14. In various embodiments of the invention, channels are provided on the outside sidewall of the cup into which scales for measuring the liquid poured into the container may slide.

It will, of course, be apparent that the present invention is not limited to the aspects of the description set forth above. Various changes and modifications of this invention as described will be apparent to those skilled in the art without departing from the spirit and scope of this invention.

What is claimed is:

1. A liquid container assembly for a spray gun, comprising:

a generally cylindrical cup having a bottom and an open top, the top including a cup lip, the cup lip including a cup lip recess;

a mounting ring, the ring including a peripheral flange and a ring recess, the peripheral flange insertable into the cup lip recess;

a collapsible liner having a liner lip at an open end, the liner insertable through the mounting ring such that the bottom side of the liner lip is received and supported by the ring recess, wherein the liner is collapsible during use as liquid is removed from the liner; and a removable lid for closing the top of the liner, wherein the ring recess includes rib segments on an inner wall of the ring recess and the lid includes a plurality of tabs, the tabs engageable with the rib segments to threadably attach the lid to the mounting ring, and the mounting ring peripheral flange and the cup lip recess are shaped such that relative rotation of the mounting ring and cup is prevented after insertion of the peripheral flange into the cup lip recess.

2. A container assembly according to claim 1, wherein the lid includes a liquid outlet and wherein the assembly further includes:

a generally cylindrical adapter, the adapter having a spray gun end and a cup end, the ends connected with a liquid-tight passageway, the spray gun end releasably engageable with a liquid inlet port of the spray gun, the cup end releasably engageable with the liquid outlet of the lid; and a collar releasably securing the cup end of the adapter to the liquid outlet.

3. A container assembly according to claim 2, wherein the lid includes at least one projection thread extending radially outwardly from the outlet and the collar includes collar threads on an interior face such that the collar secures the cup end of the adapter to the liquid outlet of the lid by mating with the at least one projection thread.

4. A container assembly according to claim 1, wherein the lid includes a locking mechanism to releasably clip the lid to the cup.

5. A container assembly according to claim 4, wherein the locking mechanism comprises hinges extending from the removable lid that lock with a flange of the cup.

6. A container assembly according to claim 1, wherein the liner includes a rounded bottom.

7. A container assembly according to claim 1, wherein the liner includes generally vertically oriented pleats.

8. A container assembly according to claim 1, wherein the liner and lid form a liquid tight seal when the lid is threaded into the mounting ring.

9. A container assembly according to claim 1, wherein the lid further comprises a bottom cylindrical projection and wherein an inner diameter of the mounting ring cooperates with the bottom cylindrical projection to compress against a sidewall of the liner when assembled for providing a liquid tight seal.

10. A container assembly according to claim 1, wherein the liner bottom is thinner than the liner side walls to promote inward collapse of the liner as fluid is withdrawn therefrom.

11. A container assembly according to claim 1, wherein the ratio of the thickness of the liner bottom to the liner sidewalls is approximately 1:1.

12. A container assembly according to claim 1 wherein the sidewall of the cup includes at least one facet.

13. A container assembly according to claim 1, further including means for removably attaching the lid to the liner.

14. A container assembly according to claim 1, further including means for removably attaching the lid to the mounting ring.

15. A liquid container assembly for a spray gun comprising:

a cup having a bottom and an open top, the top including a cup lip, the cup lip including a cup lip recess formed on an inner periphery of the cup lip;

a mounting ring, the ring including a peripheral flange and a ring recess, the peripheral flange insertable into the cup lip recess;

a liner having an open top, for holding a liquid, wherein the liner is collapsible during use as the liquid is removed from the liner; and a lid for closing the open top of the liner, wherein the lid has at least one thread for threadable engagement with the mounting ring, and the mounting ring peripheral flange and the cup lip recess are shaped such that relative rotation of the mounting ring and cup is prevented after insertion of the peripheral flange into the cup lip recess.

16. A container assembly according to claim 15, further including a locking mechanism to releasably attach the lid to the cup.

17. A liquid container assembly for a spray gun comprising:

a cup having a bottom and an open top;

a mounting ring disposed within an interior of the cup proximate the open top;

a collapsible liner having an opening, the liner insertable through the mounting ring and supported thereby within the cup such that no portion of the liner contacts the cup, wherein the liner is collapsible during use as the liquid is removed from the liner; and a lid removably covering the opening in the liner, wherein the lid has at least one thread for threadable engagement with the mounting ring, and the mounting ring and the cup are configured such that relative rotation of the mounting ring and the cup is prevented after insertion of the mounting ring into the cup.

18. A liquid container assembly for a gravity feed spray gun comprising:

a lid including a liquid outlet;

a generally cylindrical adapter, the adapter including a spray gun end and a lid end, the ends connected with a liquid-tight passageway, the spray gun end releaseably engageable with a liquid inlet port of the spray gun, the lid end releaseably coupleable with the liquid outlet;

a collar, the collar releasably attaching the adapter to the lid by rotation of the collar with respect to the lid;

a liner forming an enclosure with the lid, and a cup configured to receive the liner, wherein the lid seals with the liner and wherein the lid has at least one thread for threadable engagement with a mounting ring disposed within an open top of the cup, and the mounting ring and the cup are configured such that rotation of the mounting ring with respect to the cup is prevented after insertion of the mounting ring into the cup and the liquid container assembly is adapted to allow liquid to flow therefrom in an inverted position such that the liquid container assembly is disposed above the spray gun during use.

19. A liquid container assembly according to claim 18, the assembly further including:

a cup for receiving the lid and liner, the cup including an open top, the lid releasably attached to the open top of the cup.

20. A liquid container assembly according to claim 18, wherein the collar is threaded.

21. A liquid-tight container assembly, comprising:

a collapsible liner having a liner body defined by an open top, a peripheral sidewall and a closed bottom, said open top defined by an outwardly projecting peripheral lip, wherein the liner is collapsible during use;

a lid covering said open top of said liner, said lid having a peripheral flange sized to extend over said peripheral lip of said liner, said lid further having outwardly projecting tabs, said lid further having an outlet;

a ring having an annular recess defining an opening, said liner body extending through said opening, said peripheral lip of said liner received and supported by said annular recess, said ring further having inwardly projecting threads cooperating with said outwardly projecting tabs of said lid to secure said lid, liner and ring together as a unitized lid-liner-ring assembly; and an outer cup within which the unitized lid-liner-ring assembly is received, wherein the ring and the outer cup are configured such that rotation of the ring with respect to the outer cup is prevented after insertion of the ring into the outer cup, rotation of said lid with respect to said ring causes an underside of the peripheral flange of the lid to be forced downwardly against a top surface of the peripheral lip of the liner thereby creating a liquid tight seal between the lid and the liner, and said lid includes a filter.

22. The liquid-tight container of claim 21 wherein said outer cup includes a cup lip recess upon which said ring is supported such that said liner is suspended within said outer cup from said ring.

23. The liquid-tight container assembly of claim 21 wherein said lid includes a locking mechanism for releasably securing said unitized lid-liner-ring assembly within said outer cup.

24. The liquid-tight container assembly of claim 21 wherein said unitized lid-liner-ring assembly is removable from said outer cup.

25. A liquid container assembly for a spray gun, comprising:

a generally cylindrical cup having a bottom and an open top, the top including a cup lip, the cup lip including a cup lip recess;

a mounting ring, the ring including a peripheral flange and a ring recess, the peripheral flange insertable into the cup lip recess;

a collapsible liner having a liner lip at an open end, the liner insertable through the mounting ring such that the bottom side of the liner lip is received and supported by the ring recess;

a removable lid for closing the top of the liner, wherein the ring recess includes rib segments on an inner wall of the ring recess and the lid includes a plurality of tabs, the tabs engageable with the rib segments to threadably attach the lid to the mounting ring, and the mounting ring peripheral flange and the cup lip recess are shaped such that relative rotation of the mounting ring and cup is prevented after insertion of the peripheral flange into the cup lip recess;

a generally cylindrical adapter, the adapter having a spray gun end and a cup end, the ends connected with a liquid-tight passageway, the spray gun end releasably engageable with a liquid inlet port of the spray gun, the cup end releasably engageable with the liquid outlet of the lid; and a collar releasably securing the cup end of the adapter to the liquid outlet.

26. A container assembly according to claim 25, wherein the lid includes at least one projection thread extending radially outwardly from the outlet and the collar includes collar threads on an interior face such that the collar secures the cup end of the adapter to the liquid outlet of the lid by mating with the at least one projection thread.

* * * * *